US005901742A

United States Patent [19]

Kleppner et al.

[11] Patent Number: 5,901,742

[45] Date of Patent: May 11, 1999

[54] PRESSURE CONTROL VALVE

[75] Inventors: Stephan Kleppner, Bretten; Helmut Schwegler, Pleidelsheim; Kurt Frank, Schorndorf; Wolfgang Bueser, Freiberg, all of Germany; Uwe Liskow, Kyonggi, Rep. of Korea; Lorenz Drutu, Kornwestheim, Germany

[73] Assignee: Robert Bosch GmbH, Stuttgart, Germany

[21] Appl. No.: 08/637,773

[22] PCT Filed: Aug. 3, 1995

[86] PCT No.: PCT/DE95/01011

§ 371 Date: Jun. 19, 1996

§ 102(e) Date: Jun. 19, 1996

[87] PCT Pub. No.: WO96/07027

PCT Pub. Date: Mar. 7, 1996

[30] Foreign Application Priority Data

Aug. 27, 1994 [DE] Germany ..... 44 30 472

[51] Int. Cl.[6] ..... F02M 69/54

[52] U.S. Cl. ..... 137/508; 137/510; 251/337

[58] Field of Search ..... 137/508, 510; 251/337

[56] References Cited

U.S. PATENT DOCUMENTS

| | | | |
|---|---|---|---|
| 5,065,725 | 11/1991 | Spoetter | 137/510 |
| 5,076,320 | 12/1991 | Robinson | 137/510 |
| 5,435,345 | 7/1995 | Robinson et al. | 137/508 |

*Primary Examiner*—Stephen M. Hepperle
*Attorney, Agent, or Firm*—Edwin E. Greigg; Ronald E. Greigg

[57] ABSTRACT

A pressure control valve in which the mass to be moved by the diaphragm is reduced by providing that a valve seat body having a valve seat face is placed in a middle region of the diaphragm. When the valve seat face lifts away from the valve closing body, fuel to be diverted flows from the pressure control side of the diaphragm to the return side of the diaphragm, via the valve seat face and a return conduit The pressure control valve is especially suitable for use in fuel supply systems of internal combustion engines.

30 Claims, 10 Drawing Sheets

PRESSURE CONTROL VALVE

BACKGROUND OF THE INVENTION

The invention is based on a pressure control valve for an internal combustion engine. A pressure control valve is already known (U.S. Pat. No. 5,078,167) that is disposed on a fuel filter of a fuel supply system for an internal combustion engine and that has a base body in the middle region of which a tubular valve seat body with a valve seat face is secured. Between the base body and the valve seat body, a diaphragm is fastened firmly into the middle region, its periphery being fastened to a flange of the base body. A fuel inlet neck protrudes with great play into the valve seat body and is connected to the pressure side of the fuel feed pump. Some of the fuel flowing via the fuel inlet neck reaches the valve seat body and from there passes through the filter cloth of the fuel filter and after that, via an opening in the base body, acts on a pressure control side of the diaphragm. Connected to the return side of the diaphragm, remote from the pressure control side of the diaphragm, is a valve closing body, which in sealed fashion surrounds the fuel inlet neck and is displaced on the diaphragm by a motion of the diaphragm, so as to be lifted more or less away from the valve seat face of the valve seat body, counter to the force of a compression spring engaging the return side of the diaphragm. Such a pressure control valve is very complicated in design and because of the friction resulting from the sealing of the valve closing body on the fuel inlet neck, there is undesirable hysteresis and imprecision of control. Moreover, the valve closing body has a very large mass, which must be moved by the diaphragm fastened in its middle region and on its periphery firmly to the base body, and as a result the reaction speed of the pressure control valve to pressure changes is also impaired.

A pressure control valve is also known (U.S. Pat. 4,300,510) that is disposed on a fuel distributor line. A diaphragm of the pressure control valve is fastened on its periphery between an annular flange and the cap and in its middle region supports a valve closing body, which cooperates with a flat valve seat face on a valve seat body protruding into the fuel distributor line. A compression spring is supported on the side of the diaphragm remote from the valve seat body and on its other end rests on the cap. The pressure of the engine prevailing in the air intake line also acts on the side of the diaphragm remote from the valve seat body. Such a pressure control valve has the disadvantage that the masses that must be moved by the diaphragm are still relatively great, so that the reaction speed in the event of pressure changes is still too slow.

ADVANTAGES OF THE INVENTION

A pressure control valve of the invention, has the advantage over the prior art that it can be made in a simple way without major effort or expense, is compact in structure precisely controls the predetermined pressure, and reacts more quickly to pressure changes. The pressure control valve of the invention is also especially well-suited for controlling pressure in so-called "returnless" fuel injection systems, in which the excess fuel, pumped by the fuel pump and not injected through the injection valves, is returned to the fuel tank directly downstream of the fuel pump via the pressure control valve. Routing the return conduit through the diaphragm leads to a reduction in the masses moved and thus to an improvement in the reaction speed of the pressure control valve. The axial flow has advantages from the installation standpoint and enables better integration with other units.

Advantageous further features of and improvements to the pressure control valve are possible with the provisions recited.

As the valve closing body, it is especially advantageous to use a ball, which as is known can be made with high precision. It is also advantageous to flatten this ball so that it has a flat sealing face, which cooperates with a flat valve seat face that is moved by the diaphragm.

It is advantageous to embody the base body as a cup-shaped sheet-metal body with a bottom, and to form retaining tongues out of the bottom that are bent into the interior of the base body and partially surround the valve closing body for bearing purposes in such a way that it is rotatable.

It is also advantageous to provide a valve seat body in the middle region of the diaphragm that has the valve seat face and a return conduit leading from it to the return side.

It is additionally advantageous that the force of a restoring spring engaging the return side of the diaphragm is brought to bear by bending the bottom of the base body or of some body on which the end remote from the diaphragm of the restoring spring rests.

It is especially advantageous to embody the diaphragm resiliently from a metal and to provide it directly with the valve seat face and a return conduit leading to the return side; as a result, the expense for producing the pressure control valve and the masses to be moved can both be reduced especially sharply.

To reduce the influence of the compression force of the fuel flowing out through the return conduit on the diaphragm, it is advantageous to join a thin-walled tube in sealed fashion to the valve seat body on the return side of the diaphragm; this tube communicates for instance with a jet pump disposed in the fuel tank, on the intake side of a fuel feed pump.

It is also advantageous if a restoring spring in the form of a tension spring engages the diaphragm, the spring being embodied as a helical spring or a leaf-spring-like tension spring.

Another advantageous embodiment has the base body embodied as a cup-shaped plastic body with a bottom on which the valve closing body is supported or on which the valve closing body is embodied in integrated fashion.

It is likewise advantageous to provide a sleevelike valve closing body on the base body, with a sealing face toward the diaphragm and a sleeve bottom remote from the diaphragm, and to secure one end of a tension spring, acting as a restoring spring, to the diaphragm and the other end of the tension spring to the sleeve bottom of the sleevelike valve closing body.

It is also advantageous to fasten the diaphragm at its periphery to the base body of plastic by means of a tubular intermediate part of plastic, and to have a cup-shaped plastic cap part to engage the intermediate part, the cap part being axially movable relative to and fixible on the intermediate part.

It is also advantageous to join a valve seat body, which has the valve seat face and a return conduit leading from it to the return side, to the diaphragm, in which the valve seat body includes a valve closing body embodied as a ball disposed in a guide conduit located upstream of the valve seat face; on the return side of the diaphragm, a cap is joined to the base body, on which cap a stop body pointing at the valve closing body is disposed.

BRIEF DESCRIPTION OF THE DRAWINGS

Exemplary embodiments of the invention are shown in simplified form in the drawing and described in further detail in the ensuing description.

DETAILED DESCRIPTION OF THE EXEMPLARY EMBODIMENTS

Figure 1:
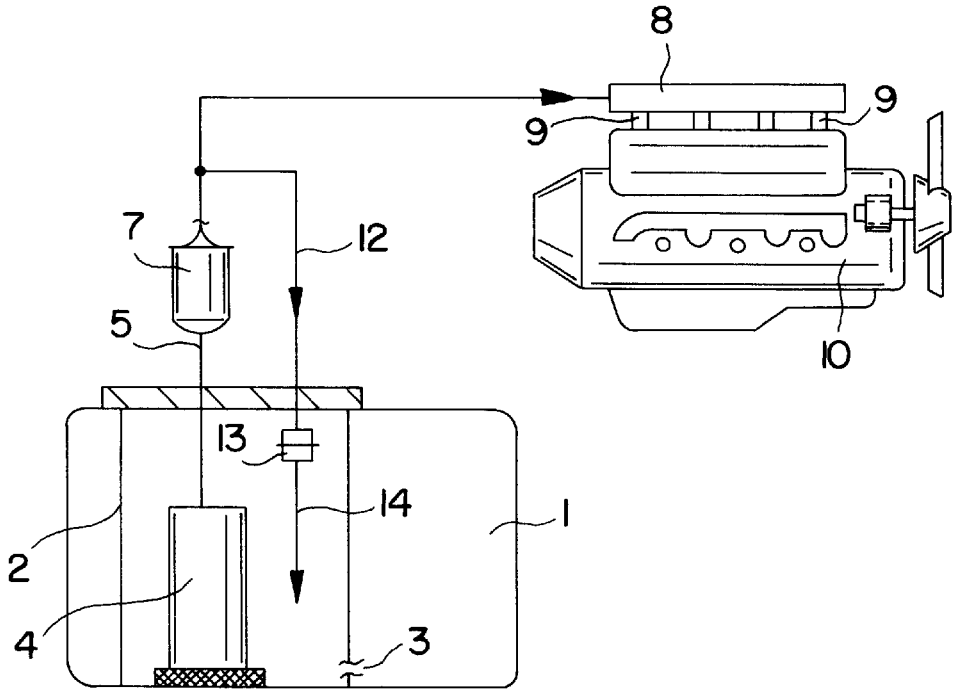
FIGS. 1–6 shows various arrangements of pressure control valves in fuel supply systems of internal combustion engines.

In FIG. 1, reference numeral 1 indicates a fuel tank into which a so-called tank insert unit 2 is inserted, which is supplied with fuel from the fuel tank 1 via a compensation opening 3 in the wall of the tank insert unit. A fuel pump 4 is disposed in the tank insert unit 2 and is driven for instance by an electric motor and furnishes fuel into a fuel line 5 to outside the fuel tank 1 In the exemplary embodiment shown in FIG. 1, a fuel filter 7 is located outside the fuel tank 1 or tank insert unit 2 in the fuel line 5. The fuel line 5 discharges into a so-called fuel distributor 8, from whence the fuel reaches injection valves 9, which are inserted into the fuel distributor and four of which, for instance, are shown. The injection valves 9 are inserted by their injection ends each into one individual intake tube of a cylinder of a mixture-compressing internal combustion engine 10 with externally supplied ignition, and they inject fuel into the immediate vicinity of the inlet valves of the individual cylinders. Downstream of the fuel filter 7, a branch line 12 that leads back to the tank insert unit branches off from the fuel line 5. In the branch line 12, inside the tank insert unit 2, there is a pressure control valve 13, which keeps the fuel pressure in the fuel line 5 upstream of the injection valves 9 constant, and by way of which the excess fuel pumped by the fuel pump 4 and not injected through the injection valves 9 is returned to the tank insert unit 2. In the process, the fuel diverted by the pressure control valve 13 either passes from the housing of the pressure control valve 13 into the tank insert unit 2 directly or flows into the tank insert unit 2 via a return line 14 provided downstream of the pressure control valve 13.

Figure 2:
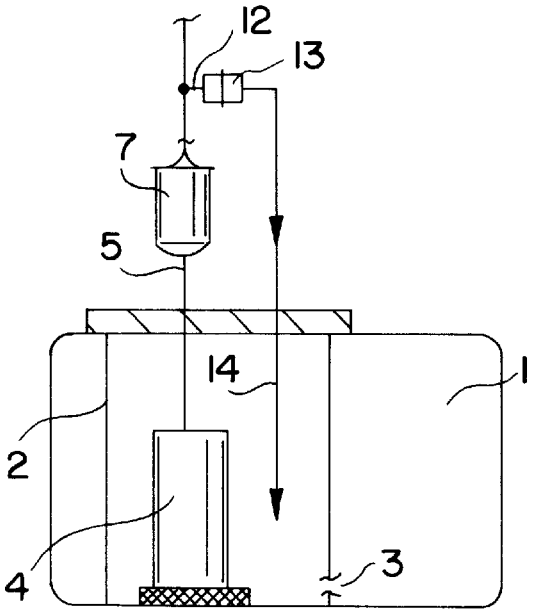

The exemplary embodiment of FIG. 2 differs from the exemplary embodiment of FIG. 1 only in that the pressure control valve 13 is located in the branch line 12 outside the tank insert unit 2 and the fuel tank 1.

Figure 3:
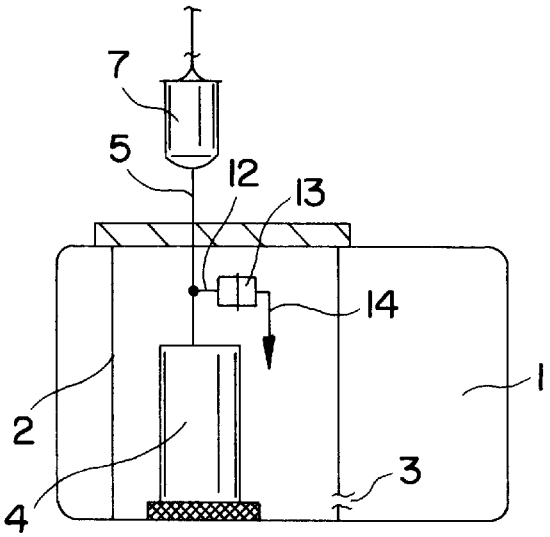

FIG. 3 shows an exemplary embodiment in which, while as in the exemplary embodiment of FIG. 1 the pressure control valve 13 is located inside the tank insert unit 2, nevertheless the branch line 12 in this exemplary embodiment of FIG. 3 already branches off from the fuel line 5 immediately downstream of the fuel pump 4, inside the tank insert unit 2. Such an embodiment, like that of FIG. 1 or 2 as well, is known as a "returnless" system, since here without long return lines, the excess fuel pumped by the fuel pump 4 and not injected through the injection valves 9 is returned to the fuel tank over the shortest possible path, or in other words without relatively long lines and hence also without undesired heating in the engine compartment. In the exemplary embodiments of FIGS. 1 and 2 as well, it can still be said that a "returnless" system is involved, since in them the return flow of excess fuel takes place in the vicinity of the fuel tank 1.

Figure 4:
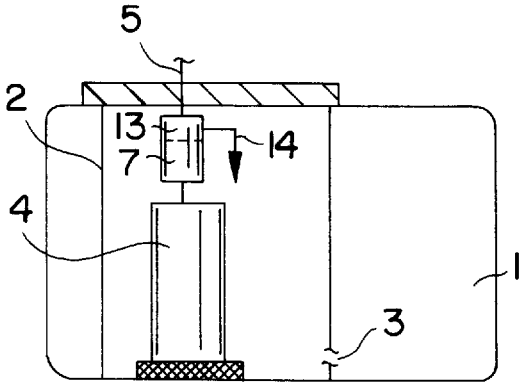

FIG. 4 again shows an exemplary embodiment of a fuel supply system embodied as a "returnless" system, in which the fuel filter 7 is also disposed directly downstream of the fuel pump 4, inside the tank insert unit 2, and the pressure control valve is mounted on the fuel filter 7 or integrated with the fuel filter 7 and is also located inside the tank insert unit 2, so that excess fuel is returned to the intake side of the fuel pump 4 again over the shortest path from the fuel line 5 inside the tank insert unit 2.

Figure 5:
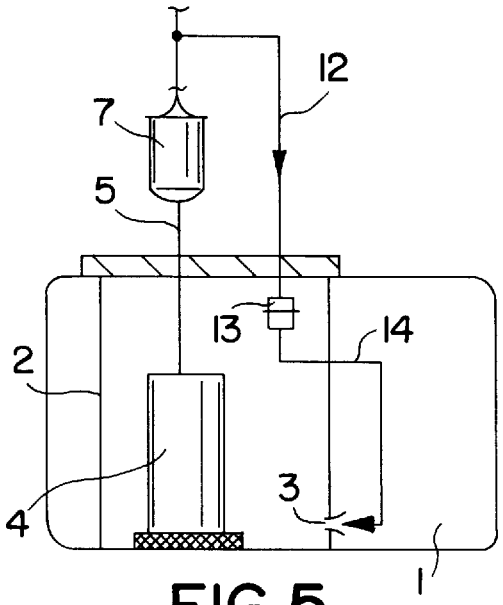

FIG. 5 shows an exemplary embodiment in which with the exemplary embodiment of FIG. 1 as a point of departure, the excess fuel diverted into the return line 14 by the pressure control valve 13 is not delivered directly to the tank insert unit 2; instead, the return line 14 terminates in a compensation opening 3, embodied as a jet pump, of the kind that is already well-known for filling such tank insert units or of the kind mounted on the intake side of fuel pumps. The return course shown in FIG. 5 of the return line 14 to the jet pump 3 can be done correspondingly in the exemplary embodiments of FIGS. 2–4 as well.

Figure 6:
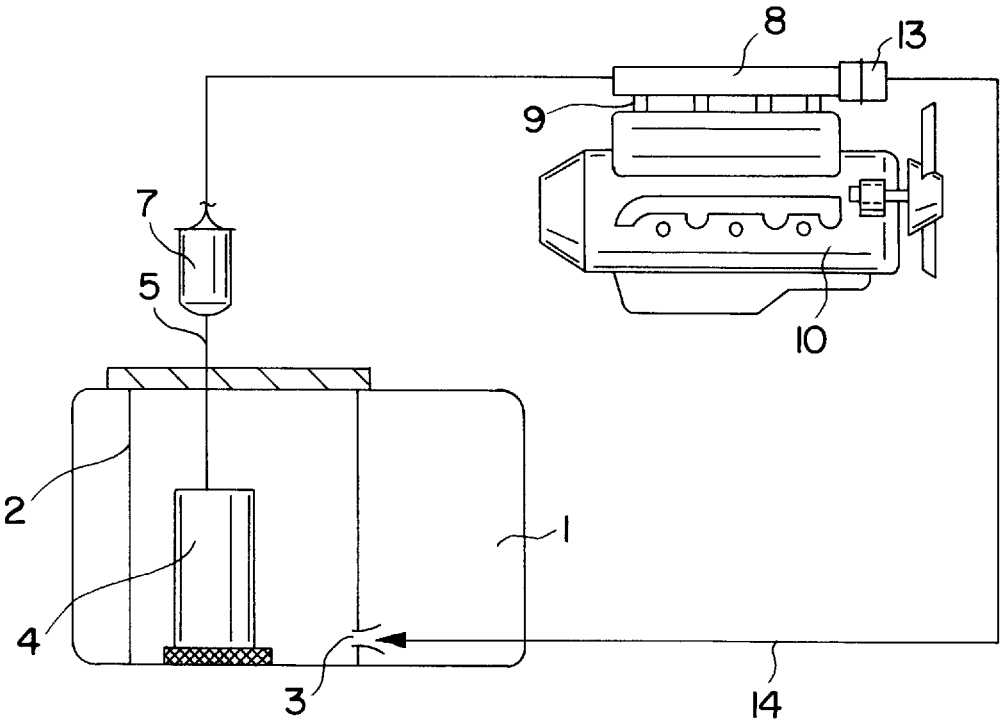

As in the above exemplary embodiments, in FIG. 6 as well the elements that remain the same and function the same as those of the exemplary embodiment of FIG. 1 are identified by the same reference numerals. In FIG. 6, the pressure control valve 13 is disposed downstream of the fuel distributor 8, preferably directly on the fuel distributor 8, and the return line 14 from the pressure control valve ends in the compensation opening 3, embodied as a jet pump, of the tank insert unit 2. FIGS. 1–6 show only some of the possible arrangements of the pressure control valves described in the following drawing figures.

Figure 7:
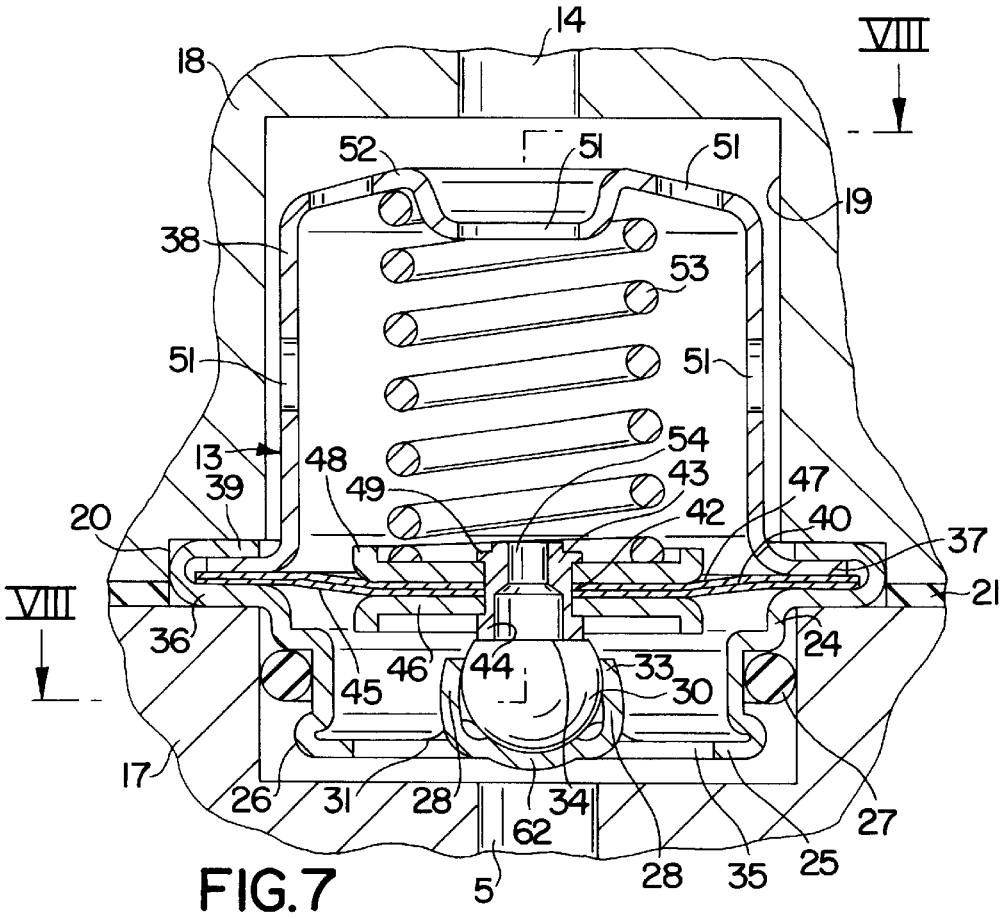
FIG. 7 shows a first exemplary embodiment of a pressure control valve of the invention.

In FIG. 7, a first exemplary embodiment of a pressure control valve 13 according to the invention is shown, which by way of example is disposed in a retaining body formed of a lower part 17 and an upper part 18. The words upper part and lower part are used here merely for the sake of better distinguishing between the two parts. The upper part and lower part may be arbitrary elements of different units. The lower part 17 and upper part 18 enclose a receiving opening 19, extending into both parts, which is interrupted, at the plane dividing the two parts 17, 18, by a fastening opening 20 of a larger diameter in at least one of the parts. An elastic seal 21 can for instance be provided in the dividing plane between the lower part 17 and the upper part 18. In the lower part 17, the fuel line 5 leads into the receiving opening 19, while in the upper part 18 the return line 14 leads away from the receiving opening 19. The carrier body formed of the parts 17, 18 may be embodied as a separate part, but it may also be part of the fuel tank 1, the tank insert unit 2, the fuel pump 4, the fuel filter 7, the fuel distributor 8, or some other unit of the fuel supply system. On installation of the pressure control valve 13 inside the fuel tank 1 or tank insert unit 2, it is possible for a closed upper part 18 to be dispensed with, since the diverted fuel can flow directly back from the pressure control valve into the tank insert unit 2 or the fuel tank 1.

The pressure control valve 13 has a base body 24, embodied as a cup-shaped, stepped sheet-metal body that has a bottom 25. Beginning at the bottom 25, a bead 26 is formed on the circumference of the base body 24; it defines a groove for a sealing ring 27 disposed on the circumference of the base body. The sealing ring 27 rests sealingly not only on the circumference of the base body 24 but also on the wall of the receiving opening 19 and thus divides the part of the receiving opening 19 communicating with the fuel line 5 from the part of the receiving opening 19 communicating with the return line 14. At least two retaining tongues 28 are formed out of the bottom 25 and bent into the interior of the base body 24, where they form a kind of cage for supporting a ball-like valve closing body 30. The valve closing body rests on the bottom 25, and the retaining tongues 28 are somewhat longer than the radius of the valve closing body 30, which is embodied as larger than a hemisphere, and with their free ends 33 they close an imaginary circle that has a smaller diameter than the diameter of the ball-like valve closing body 30 In any case, there is play between the retaining tongues 28 and the ball-like valve closing body, such that the ball-like valve closing body can rotate freely between the retaining tongues 28 but cannot fall out of the cage formed by them. A leaf-spring-like cocking spring 31 formed out of the plane of the retaining tongues and having four spring tongues 32, for instance, is disposed between the bottom 25 of the base body 24 and the ball-like valve closing body 30 and exerts a slight spring force on the valve closing body 30, so that it is held at the free ends 33 in the retaining tongues 28, thus preventing the valve closing body 30, if jarring and shaking occur, for moving constantly relative to the retaining tongues 28, which would cause undesired wear phenomena. The ball-like valve closing body 30 is flattened and has a flat sealing face 34. After being flattened, the ball-like valve closing body 30 is still larger than a hemisphere.

Remote from the bottom 25, the base body 24 has a collar 36, which is annular and on which a diaphragm 40, or a plurality of diaphragms 40 placed one above the other, rests by its or their periphery. An annular shoulder 37 of a cup-shaped cap 38 rests on the circumference, on the side of the diaphragm 40 or diaphragms 40 opposite the collar 36. A crimp edge 39 adjoining the collar 36 of the base body 24 is bent in a U over the annular shoulder 37 of the cap 38 and exerts a fastening force with which the periphery of the diaphragm 40 or diaphragms 40 is fastened firmly between the collar 36 and the annular shoulder 37. The diaphragm 40 is shaped in such a way, or has a material such, that it is resilient or elastic. The diaphragm 40 or diaphragms 40 may be formed of rubber, a cloth with rubber coating, plastic, or metal in the form of thin foils.

The pressure control valve 13 protrudes by its collar 36 or crimped edge 39 into the fastening opening 20 between the lower part 17 and the upper part 18 and is retained in it.

In its middle region, the diaphragm 40 has an aperture 42, through which a cylindrical valve seat body 43 is thrust that has a flat valve seat face 44 toward the valve closing body 30. A counterpart disk 46 rests in the middle region of the diaphragm, on a pressure control side 45 of the diaphragm 40 toward the valve closing body 30, and a spring plate 48 rests in the middle region of the diaphragm, on a return side 47 of the diaphragm 40 toward the cap 38. The counterpart disk 46 and the spring plate 48 also have apertures, aligned with the aperture 42 of the diaphragm 40, through which apertures the valve seat body 43 extends and protrudes, with a radially extending deformation 49, past the spring plate 48 and exerts a cocking force in the axial direction that sealingly braces the valve seat body 43, the counterpart disk 46 and the spring plate 48 on the diaphragm 40 axially against one another. On the side toward the valve closing body 30, the valve seat body 43 protrudes radially with an annular edge past the counterpart disk 46.

The cap 38 has at least one outflow opening 51, which may be provided in the cap bottom 52 and/or in the cylindrical jacket part of the cap. A restoring spring 53 embodied as a compression spring is supported on the cap bottom 52; it likewise engages the spring plate 48 and thus urges the diaphragm 40 and the valve seat body 43 in the direction toward the valve closing body 30. The spring force of the restoring spring 53, which determines the fuel pressure to be controlled, can be exerted by axially pressing in on or pulling out the cap bottom 52 and/or the bottom 25 of the base body 24 in a central bearing region 62. If the predetermined fuel pressure on the pressure control side 45 of the diaphragm 40 is exceeded, then the diaphragm 40 lifts the valve seat body 43 away from the valve closing body 30, and fuel flows along the sealing face 34 and along the valve seat face 44 and from there, via a return conduit 54 formed in the valve seat body 43, to the return side 47 of the diaphragm and into the interior of the cap 38. As a result of the outflow openings 51 in the cap 38, the fuel can also flow directly back into the tank 1 or tank insert unit 2, omitting the other part 18, if the pressure control valve 13 is built in there.

The forming of the retaining tongues 28 creates inlet openings 35 in the bottom 25 of the base body 24, by way of which openings the fuel, reaching the receiving opening 19 from the fuel line 5, flows into the interior of the base body 24. The webs remaining in the bottom 25 between the inlet openings 37 lend the central bearing region 62 of the bottom, in which the valve closing body 30 is supported, the capability of plastically deforming this central bearing region by exerting only slight forces.

Figure 8:
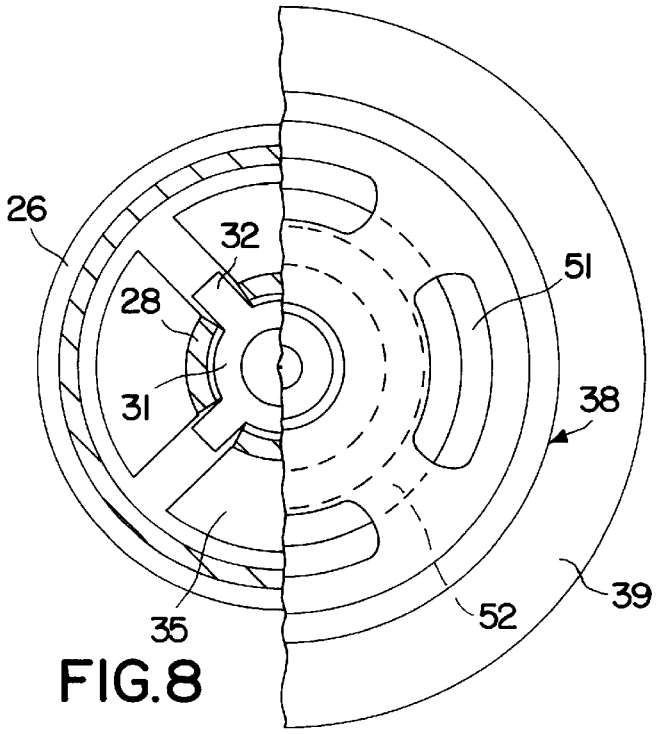
FIG. 8 is a section taken along the line VIII—VIII of FIG. 7.

FIG. 8 shows a plan view on the pressure control valve of FIG. 7, along the line VIII—VIII.

The valve seat body 43, the counterpart disk 46 and the spring plate 48 may be made of metal, a suitable plastic, or some other material, such as ceramic.

In the exemplary embodiments of pressure control valves according to the invention, described in the following FIGS. 9–27, those elements of the pressure control valves that remain the same and function the same as in FIGS. 7 and 8 are identified by the same reference numerals. For these identical and identically functioning parts, reference is expressly made to the description of FIGS. 7 and 8, so that this matter will not be described again here. The exemplary embodiment of a pressure control valve shown in FIG. 9 differs from the pressure control valve of FIG. 7 essentially only in that the valve closing body 30 is embodied as a complete ball, or in other words without any flattening as the sealing face, and the valve seat face 44 on the valve closing body is likewise not flat but instead is shaped conically or spherically. The valve seat body 43 is provided integrally with a disk end 55 on its side resting on the pressure control side 45 of the diaphragm, so that the counterpart disk 46 provided in the pressure control valve of FIG. 7 is dispensed with. Once again, the valve seat body 43 and the spring plate 48 may comprise plastic, metal or some other material. On the bottom 25 of the base body 24, at the transition to the cylindrical jacket region, detent tongues 57 are formed out and bent radially outward. From behind, these detent tongues 57 engage detent protrusions 58 of an annular disklike filter body 59, across which a filter cloth 60 is spread, covering the inlet openings 35 outside the base body 24. This filter 59, 60 prevents particles entrained in the fuel from reaching the region between the valve closing body 30 and the valve seat face 44 and damaging these faces or from sticking there and thus impairing the function of the pressure control valve.

Figure 9:
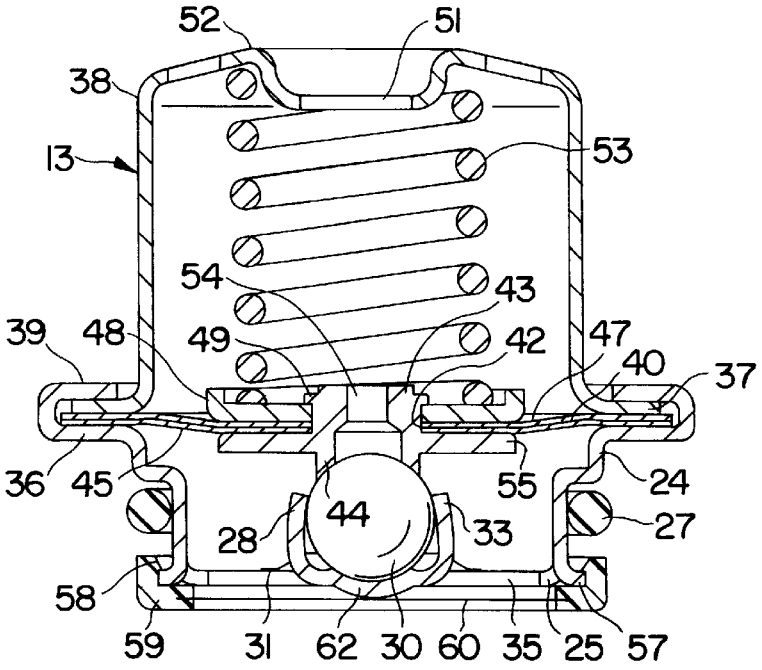
FIGS. 9–23 show a second to a seventeenth exemplary embodiment of a pressure control valve of the invention.
Figure 10:
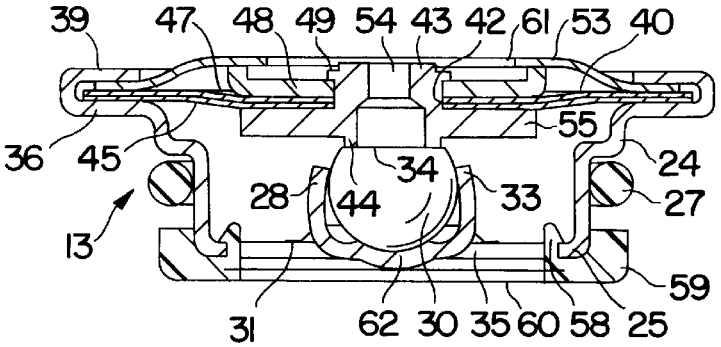

In the exemplary embodiment of FIG. 10, a filter 59, 60 is again provided, whose detent protrusions 58 however extend through the inlet openings 35 and engage the bottom 25 of the base body 24 from behind on the inside, so that no detent tongues 57 as in the exemplary embodiment of FIG. 9 are needed. Moreover, no cap is provided. In this exemplary embodiment, the restoring spring 53 is embodied as a striplike or annular leaf spring, which is fastened on its circumference to the diaphragm 40 by the crimp edge 39 on the base body 24 and which extends radially inward far enough that it engages the spring plate 48 and defines a flow opening 61 for the fuel flowing out of the return conduit 54. The use of a leaf spring as a restoring spring makes a very short embodiment of the pressure control valve 13 in the axial direction possible.

Figure 11:
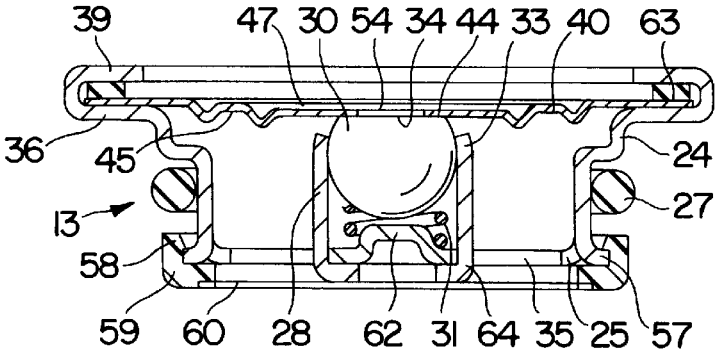

FIG. 11 shows the use of a thin, foil-like metal diaphragm 40, which is embodied as elastically resilient by means of additional corrugated regions and is fastened at its periphery, with the interposition of a seal 63, to the collar 36 of the base body 24 by the crimped edge 39. In its middle region, the diaphragm 40 is embodied as flat in order to form the valve seat face 44, and it there has the return conduit 54 to the return side 47. The diaphragm 40 may, however, also be bent in the region of the return conduit 54 toward the flat sealing face 34 of the ball-like valve closing body 30, so that in a manner not shown, an annular valve seat face 44 is formed on the diaphragm 40. For control purposes, the only mass that must be moved is that of the diaphragm, and as a result a particularly fast speed of response to pressure changes is obtained. The diaphragm cooperates with a flat sealing face 34 of the ball-like valve closing body 30 that is supported in a central bearing region 62 of the bottom 25 of the base body 24 by a cup-shaped retaining sleeve 64, which reaches with retaining tongues 28 through inlet openings 35 provided in the bottom 25 and, in the manner described for FIG. 7, rotatably supports the valve closing body 30 by means of the retaining tongues. The retaining sleeve 64 rests with a constriction on the outside of the bottom 25. A cocking spring 31 embodied as a compression spring between the bottom 25 and the valve closing body 30 urges the valve closing body 30 toward the free ends 33 of the retaining tongues 28, and as a result the valve closing body 30 and the retaining sleeve 64 are pressed toward the diaphragm 40. The spring properties of the diaphragm 40 can be varied by means of the shaping of the corrugated regions. Instead of the crimping on the collar 36 of the base body 24, a soldered or welded connection of the periphery of the diaphragm 40 to the collar 36 can be made.

Figure 12:
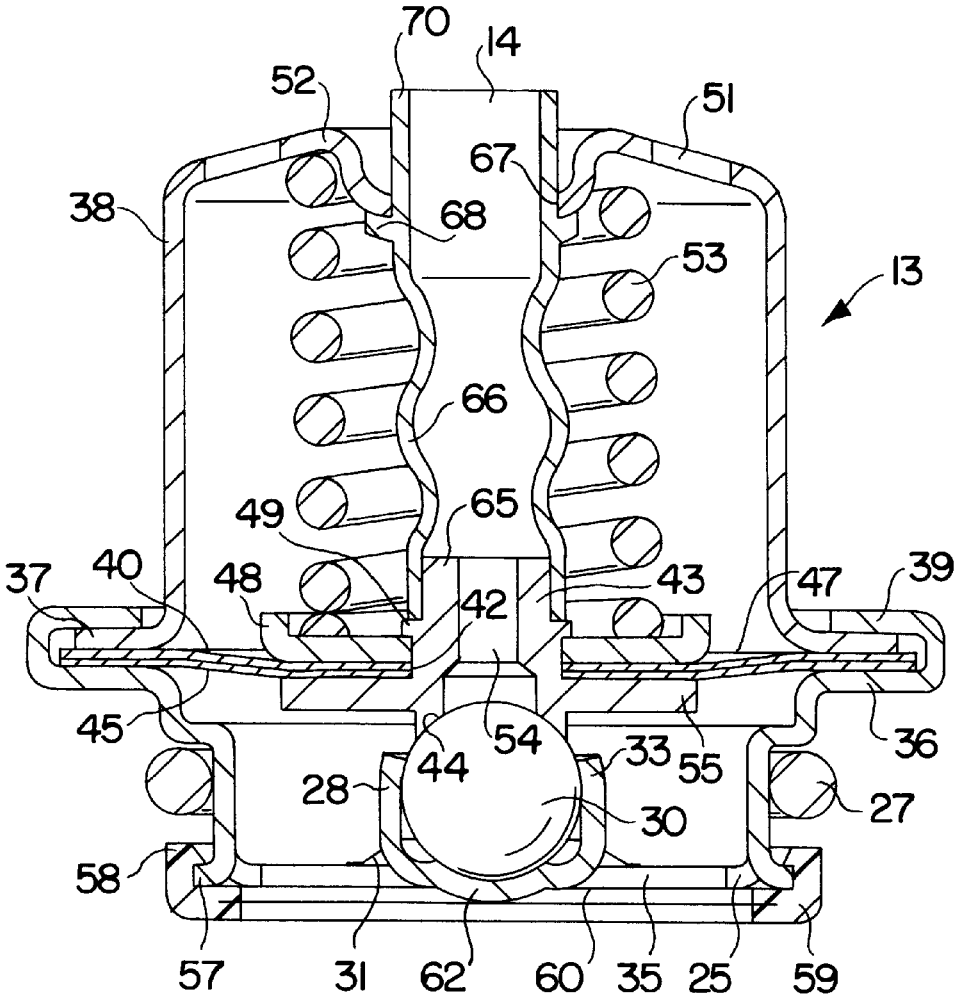

The exemplary embodiment of a pressure control valve of FIG. 12 is essentially equivalent to the pressure control valve of FIG. 9, except to reduce the compression force of the returning fuel on the diaphragm 40, a corrugated return tube 66 is mounted tightly onto a mounting shoulder 65 of the valve seat body 43, on its side remote from the valve seat face 44.

Figure 13:
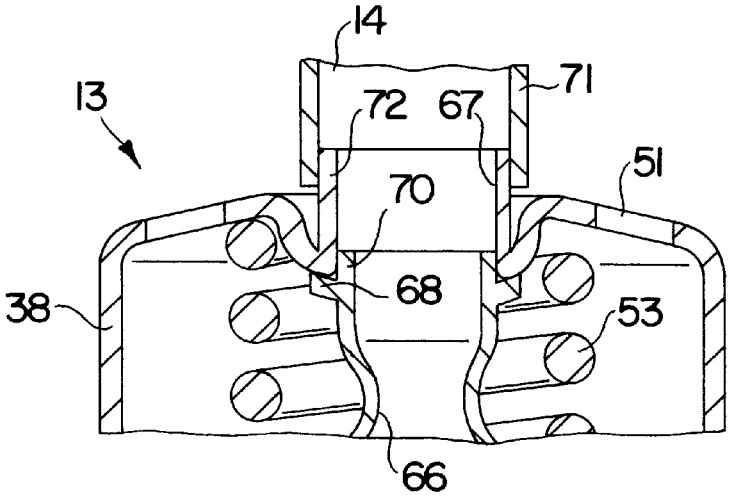
Figure 14:
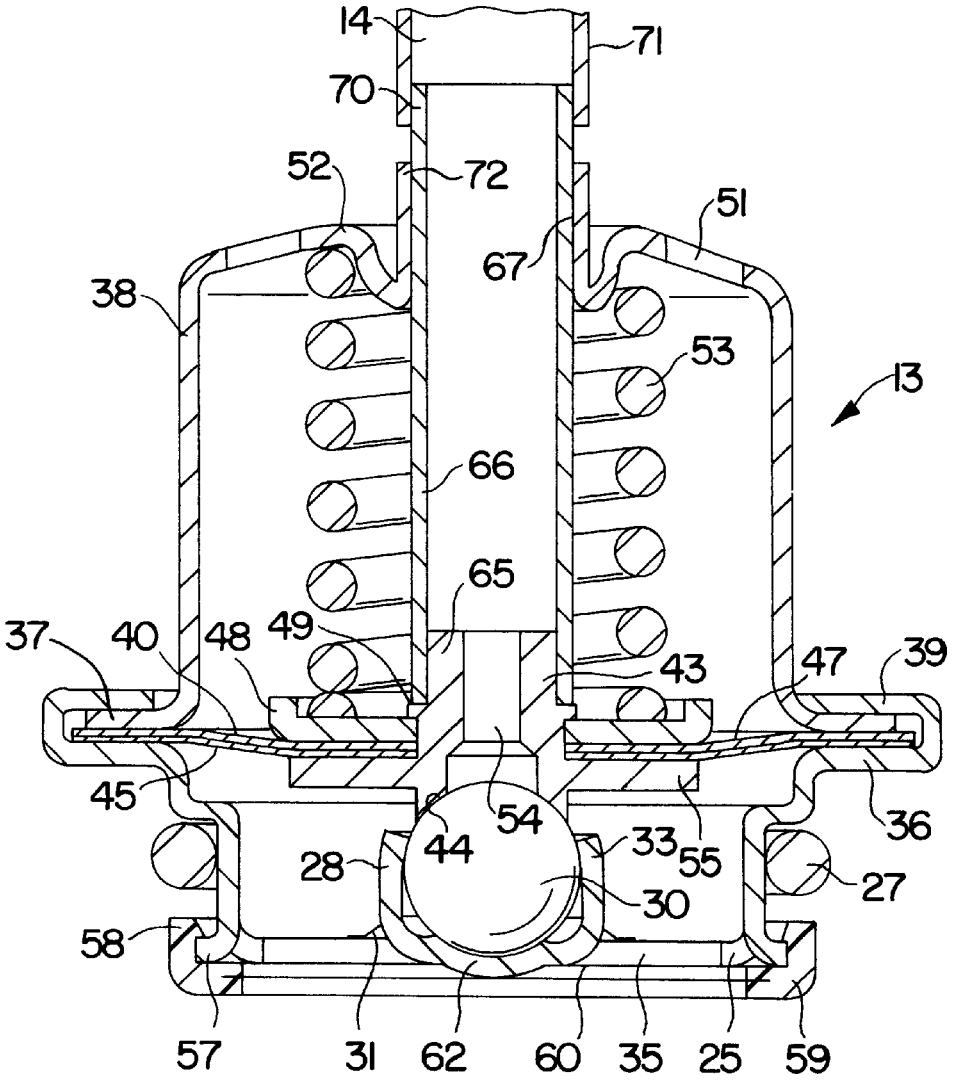

The flexible return tube 66 may be made of rubber, plastic, thin metal or some other material, and it extends through the restoring spring 53 and a guide opening 67 in the cap bottom 52, on the inside of which the return tube 66 can rest with radially extending stops 68. In that case, as shown in FIGS. 13 and 14, a connection hose 71 can be slipped tightly onto a tube end 70 protruding from the cap 38; as FIGS. 1–6 show, this hose leads back in the form of a return line 14 to the fuel tank 1 or the tank insert unit 2. This embodiment with the return tube is especially advantageous whenever the returned fuel is supplied to the jet pump 3 in the fuel tank 1, because as a result the effects of pressure fluctuations in the fuel on the pressure control valve can be kept especially slight, since these pressure fluctuations act only on the small cross section of the valve seat body 43, rather than on the substantially larger cross section of the diaphragm 40.

FIG. 13 shows merely the upper portion of the cap 38, which has a tubular neck 72, forming the guide opening 67, that protrudes out of the cap. The end 70 of the return tube 66 terminates, sealed off, in the tube neck 72. The connection hose 71 is slipped over the tube neck 72. In FIG. 14, unlike the above exemplary embodiments of FIGS. 12 and 13, the return tube 66 is embodied not as a corrugated tube but rather as a smooth tube, which protrudes through the guide opening 67 in the cap 38 with slight play, or in other words can slide in the guide opening 67.

Figure 15:
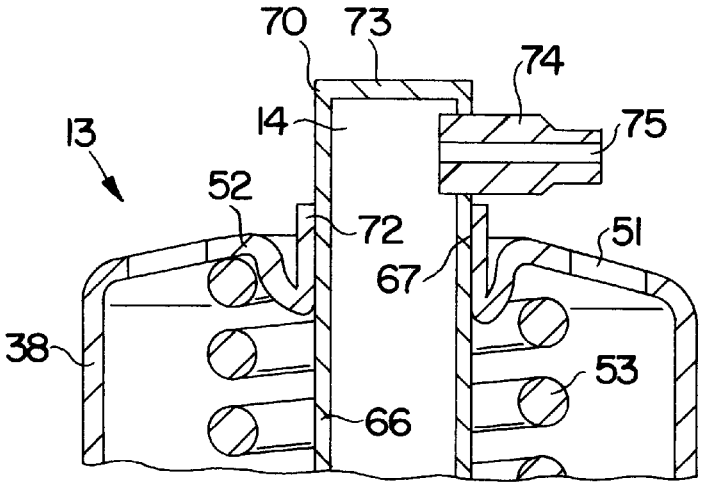

The exemplary embodiment of FIG. 15, which shows only the upper portion of the cap 38, differs from the exemplary embodiment of FIG. 14 merely in that the tube end 70 protruding out of the cap 38 is provided with a closure 73 and that in the cylindrical wall of the return tube 66 outside the cap a jet nozzle 74 is provided, by way of whose jet conduit 75 the returning fuel is introduced directly into the jet pump 3. The jet nozzle 74 is thus part of the jet pump in the fuel tank 1. In principle, however, combinations of the exemplary embodiments described above are also possible, for instance with respect to how the filter is fastened, how the closure element is formed, and so forth.

Figure 16:
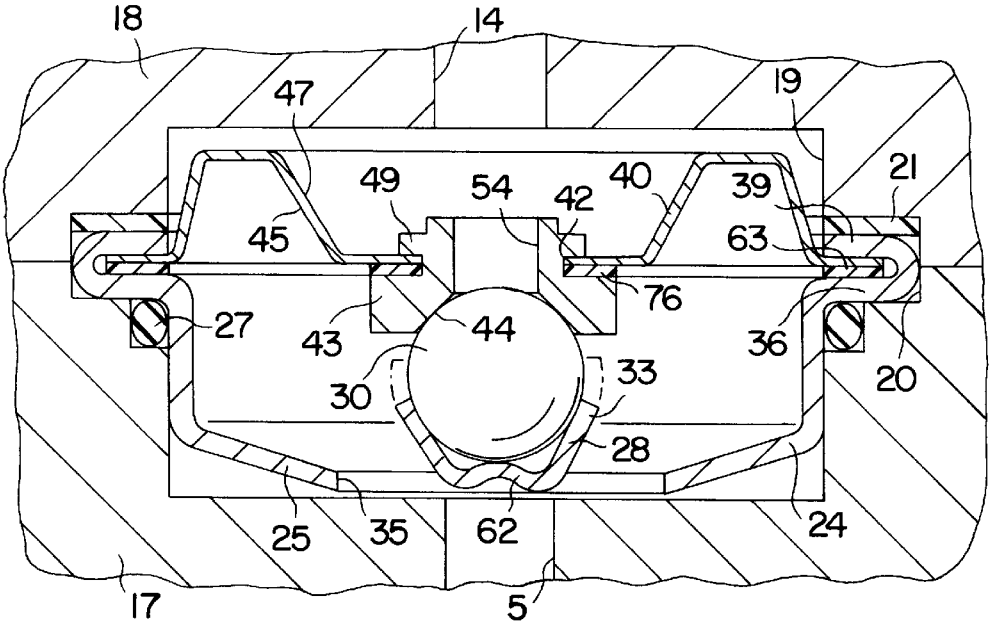

In the exemplary embodiment of FIG. 16, a resilient diaphragm 40 of thin metal is fastened by its periphery in the base body 24, by means of the collar 36 and crimped edge 39 with the interposition of a seal 63, and is bent in corrugated fashion in such a way that it also, simultaneously acting as a restoring spring, exerts a spring force on the valve seat body 43 in the direction of the valve closing body 30. The valve seat body 43 extends through an aperture 42 in the middle region of the diaphragm 40 and is likewise tightly secured, optionally with the interposition of a sealing disk 76, by means of a deformation 49 onto the side of the diaphragm 40 remote from the valve closing body 30. The valve seat face 44 is embodied conically or spherically In FIGS. 16–19, the retaining tongues 28 do not surround the valve closing body, embodied for instance as a ball, above its center point. In the exemplary embodiments of FIGS. 16–19 as well, however, the retaining tongues 28 may be embodied as long enough that as in the above FIGS. 7–14 they surround the ball above its middle point. These longer retaining tongues 28 are shown in dashed lines as an example in FIG. 16. The valve closing body 30 is rotatably supported between the retaining tongues 28. By pressing in the bottom 25 of the base body 24 in the central bearing region 62 between the retaining tongues 28, the force exerted by the metal diaphragm 40 and thus the fuel pressure to be controlled can be varied. In this exemplary embodiment, no independent restoring spring and thus no spring plate on the diaphragm are needed.

Figure 17:
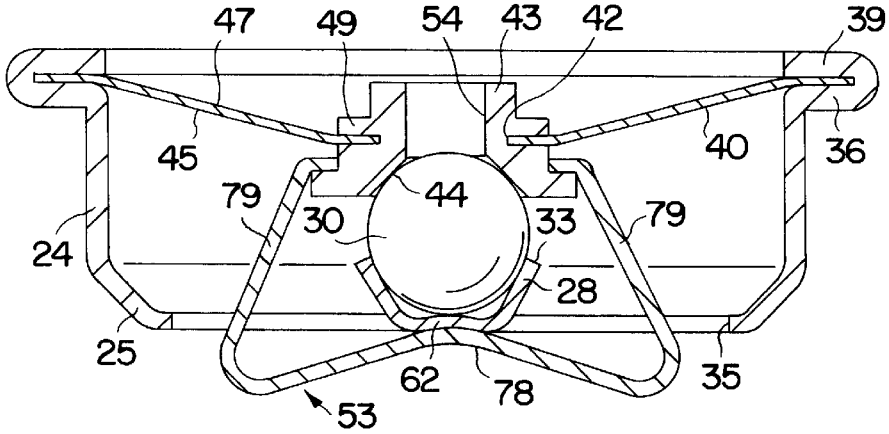

In a departure from the exemplary embodiment of FIG. 16, in the exemplary embodiment of FIG. 17 the diaphragm 40, which may for instance be of plastic instead of metal, is equipped with at most a very slight spring property. Acting as the restoring spring 53 is a tension spring, which is embodied as an approximately heart-shaped leaf spring and is supported with a transverse region 78 outside the base body 24 on the bottom 25 thereof and which with arms 79 engages the valve seat body 43, in order to pull the valve seat body 43 together with the diaphragm 40 in the direction of the valve closing body 30. The arms 79 in the process extend through the inlet openings 35 in the bottom 25.

Figure 18:
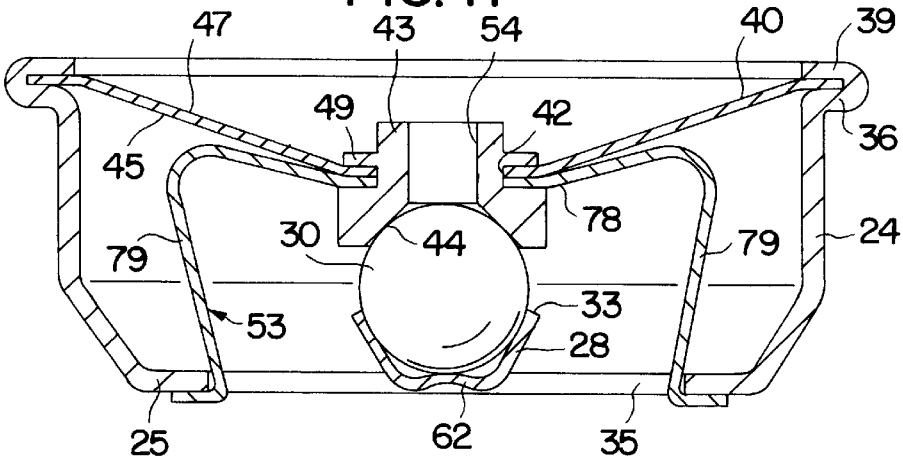

In the exemplary embodiment of FIG. 18 as well, the restoring spring 53 acts as a tension spring upon the valve seat body 43 and urges the diaphragm 40 in the direction of the valve closing body 30 and is embodied as an approximately heart-shaped leaf spring. Unlike the exemplary embodiment of FIG. 17, however, the transverse region 78 is fastened together with the diaphragm 40 to the valve seat body 43, and the arms 79 extend through the inlet openings 35 to the outside and are supported on the bottom 25 of the base body 24.

Figure 19:
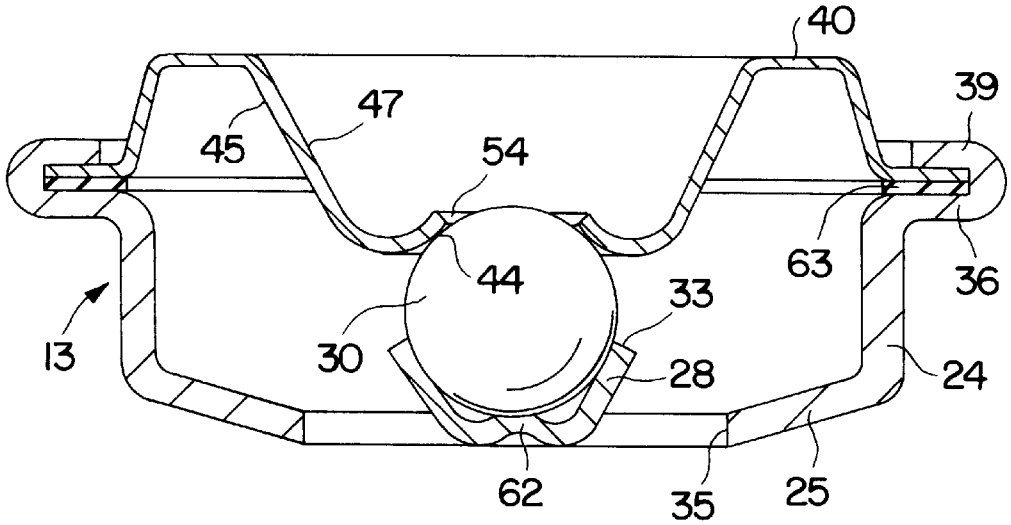

FIG. 19 shows an exemplary embodiment of a pressure control valve 13 that as in FIG. 11 or FIG. 16 has a diaphragm 40 embodied resiliently of metal that at the same time, acting as a restoring spring, rests with a spring force on the valve closing body 30, in the closed state of the pressure control valve as in FIG. 11. The diaphragm 40, in its middle region, forms a valve seat face 44 and a return conduit 44, beginning there, to the return side 47. For forming the valve seat face 44, the diaphragm 40 is bent tapering upward conically or spherically toward the middle and toward the return conduit 54, so as to rest in the manner of a nozzle on the circumference of the ball-like valve closing body 30.

Figure 20:
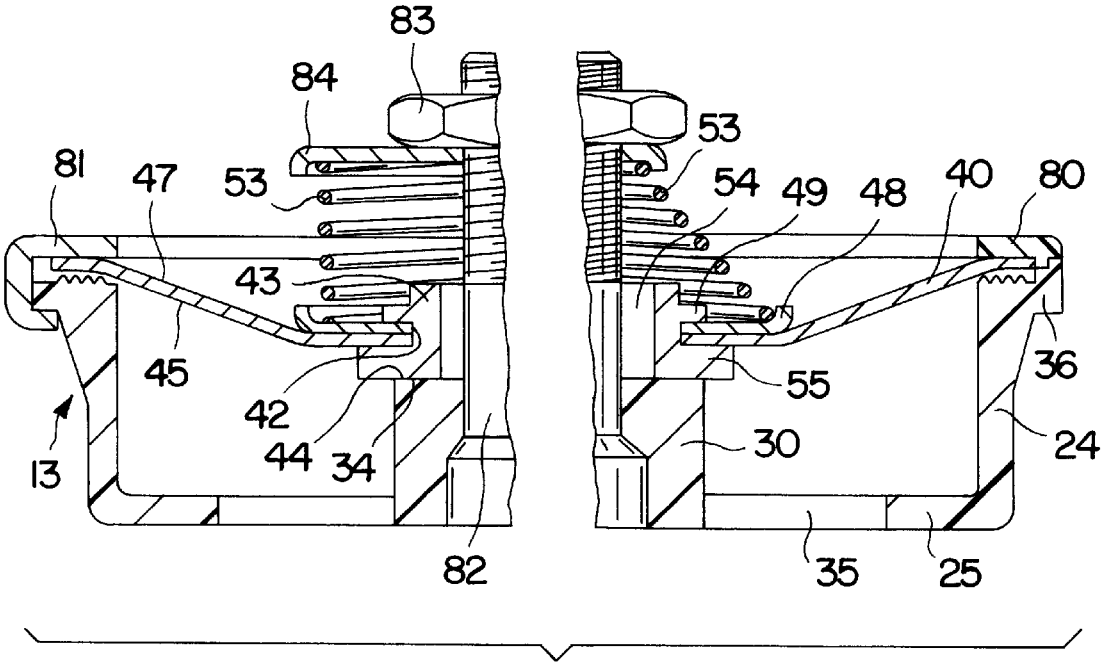

In FIG. 20, a pressure control valve 13 is shown whose base body 24 is embodied as a cup-shaped plastic body with a bottom 25. Inlet openings 35 are provided in the bottom 25, and in the middle region of the bottom a valve closing body 30 is formed in raised fashion as an integral component; this body has a flat sealing face 34 and protrudes into the interior of the base body 24. At a collar 36 of the base body 24, the periphery of the diaphragm 40 is fastened either by a fastening ring 80 of plastic, as shown on the right-hand side of FIG. 20, or by a U-shaped clamping ring 81 of metal, as shown as a variant on the left-hand side of FIG. 20. The plastic fastening ring 80 is preferably joined by ultrasound welding to the collar 36 of the base body 24. In the middle region of the diaphragm 40, the valve seat body 43 is inserted through the aperture 42 and joined by means of the deformation 49 to the diaphragm 40, with the interposition of the spring plate 48. The likewise flat valve seat face 44 and the valve seat body 43 cooperates with the flat sealing face 34 of the valve closing body 30, which is formed in one piece with the base body 24. A pin 82 which has a smaller cross section than the return conduit 54 in the valve seat body 43 is secured to and protrudes through the valve closing body 30. The end of the pin 82 remote from the valve closing body 30 is provided with a male thread onto which a screw 83 is screwed, on which screw a counterpart bearing disk 84 is supported. The restoring spring 53, embodied as a compression spring, rests on both the counterpart bearing disk 84 and the opposed spring plate 48 and may be embodied cylindrically, as shown on the left-hand side or conically, as shown on the right-hand side. The securing of the diaphragm to the metal clamping ring 81 is done by means of the clamping force exerted on the diaphragm 40 by the clamping ring 81 in the direction of the collar 36.

Figure 21:
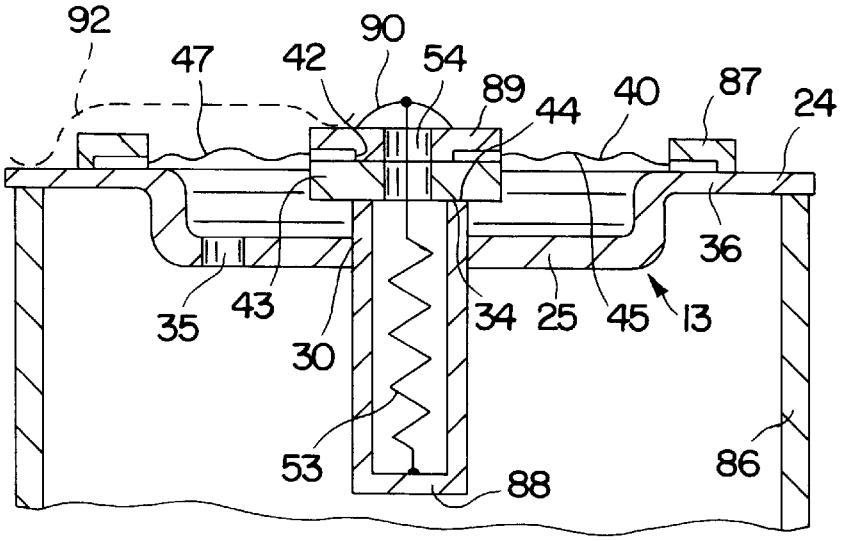
Figure 22:
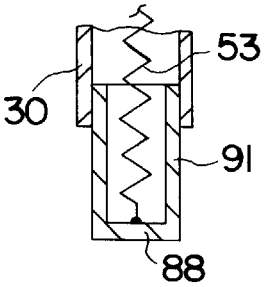

FIG. 21 shows a pressure control valve 13 whose cup-shaped base body 24, which has a low axial height, is disposed on a tubular unit 86 of the fuel supply system, for instance a fuel filter. The periphery of the resilient diaphragm 40 of rubber, coated cloth, plastic or metal rests on a collar 36 of the base body 24 and is secured to it with a clamping body 87 joined to the collar 36. A sleevelike valve closing body 30 is secured in the middle region of the bottom 25 of the base body 24; its annular end face toward the diaphragm 40 forms a flat sealing face 34, and its other end face is located outside the base body 24 and is closed by a sleeve bottom 88. A valve seat body 43 that forms a flat valve seat face 44 is joined to the diaphragm, in that the valve seat body, between it and a diaphragm plate 89 disposed on the return side 47 of the diaphragm fastens the middle region of the diaphragm around the aperture 42. Beginning at the valve seat face 44, the return conduit 54 extends through the valve seat body 43 and the diaphragm plate 49. The sleeve bottom 88 is engaged by one end of the restoring spring 53, in the form of a tension spring extending through the valve closing body 30 and the return conduit 54, whose other end is secured to a spring bracket 90 that rests on the diaphragm plate 89. The force of the restoring spring 53 may be brought to bear for instance by bending the spring bracket 90, which by way of example may be cross-shaped or triangular. Another option for varying the force of the restoring spring 53 is shown in FIG. 22, in which a bottom sleeve 91 is supported displaceably or rotatably in or on the valve closing body 30, and is engaged by one end of the restoring spring 53. Once the spring force of the restoring spring 53 has been adjusted, the sleevelike valve closing body 30 and the bottom sleeve 91 are joined together nonpositively or positively. A further option for adjusting the restoring force on the diaphragm 40, besides the restoring spring 53, is suggested in FIG. 21 by the additional spring 92 shown in dashed lines, which is embodied as a leaf spring and one end of which is secured to the base body 24, while the other end engages the diaphragm plate 89. Bending the additional spring 92, in addition to the force of the restoring spring 53, makes it possible to adjust the desired restoring force on the diaphragm 40.

Figure 23:
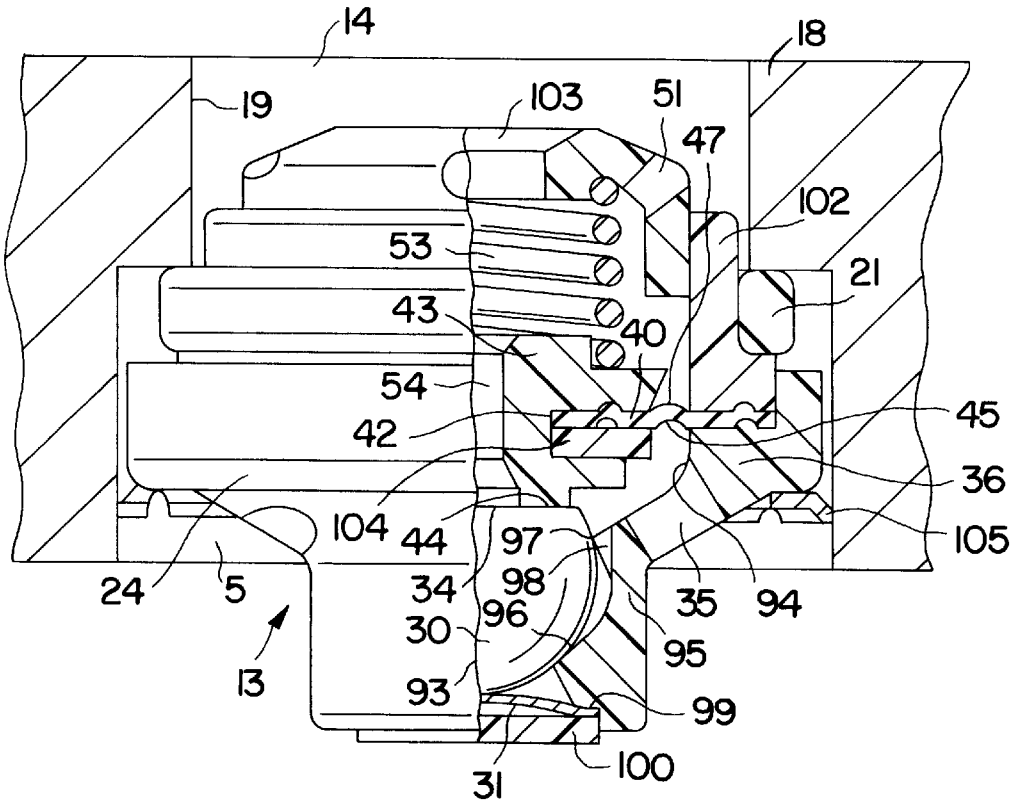
Figure 24:
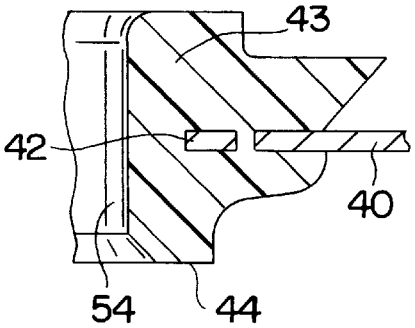
FIGS. 24 and 25 show fragmentary views of the pressure control valve of FIG. 23.
Figure 25:
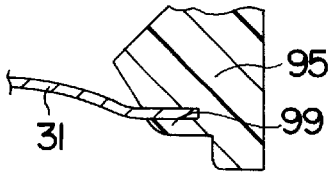

In the exemplary embodiment of FIG. 23, a pressure control valve 13 made substantially from plastic is disposed in an upper part 18, for instance a fuel filter or a holder body, in the fuel tank. The pressure control valve 13 has a plastic base body 24, whose wall defines an interior 94 that is stepped in both axial directions. A collar 36 on which the diaphragm 40 rests with its periphery is formed on the base body 24. Remote from the collar 36, the base body 24 has a bearing portion 95 for supporting the valve closing body 30. To that end, the bearing portion 95 has an annular bearing face 96 that tapers conically toward the center line 93 and whose smallest diameter is smaller than the diameter of the ball-like valve closing body 30. The bearing face 96 is adjoined, in the direction toward the collar 36, by retaining lugs 97, which extend axially to beyond the middle of the ball-like valve closing body 30 and radially have a slight play with the surface of the valve closing body 30, so that the valve closing body can rotate-between the retaining lugs 97. The retaining lugs 97 may also be located on an encompassing continuous retaining ring having the same cross section and the retaining lugs. To make it easier for the ball-like valve closing body 30 to snap into the bearing portion 95 when the valve closing body 30 is installed, axially extending longitudinal slits 98 may be provided between the individual retaining lugs 97 in the wall of the base body 24, the slits being open toward the interior 94. A cup-spring-like cocking spring 31 rests with its circumference on a collar 99 of the bearing portion 95, the collar being is remote from the valve closing body 30, and is fastened firmly by means of a cap 100 that is joined to the bearing portion 95, for instance by ultrasound welding. The cocking spring 31 is embodied as soft, and it urges the valve closing body 30 toward the retaining lugs 97. As shown in FIG. 25, the circumference of the cocking spring 31 can also, by deformation of the plastic material on the collar 99 by ultrasound welding, be fastened directly in the bearing portion 95. The diaphragm 40 resting on the collar 36 of the base body 24 is fastened on the collar 36 by means of a tubular intermediate part 102 of plastic, which is joined to the collar 36 by ultrasound welding. A cup-shaped cap part 103 of plastic can be inserted into the intermediate part 102 or onto the intermediate part 102, and it is engaged by one end of the restoring spring 53 embodied as a compression spring. By means of an axial motion of the cap part 103 relative to the intermediate part 102, the force of the restoring spring 53 can be varied. Once the spring force adjustment has been completed, the intermediate part 102 and the cap part 103 are fixed to one another. Outflow openings 51 are provided in the cap part. In the middle region of the diaphragm 40, extending through the aperture 42 of the diaphragm 40, a plastic valve seat body 43 is secured, which rests with its valve seat face 44 on the sealing face 34 of the valve closing body 30 and has the return conduit 54. The fastening of the diaphragm 40 to the valve seat body 43 can be done by means of a fastening disk 104, which is made of plastic and is joined to the valve seat body 43 by ultrasound welding. In a variant, shown in FIG. 24, of the pressure control valve 14 of FIG. 23, the diaphragm 40 is fastened in its middle region directly into the valve seat body 43, which has been deformed by ultrasound welding. The pressure control valve 13 is retained in the upper part 18 by means of a metal toothed ring disk 105 engaging the collar 36.

Figure 26:
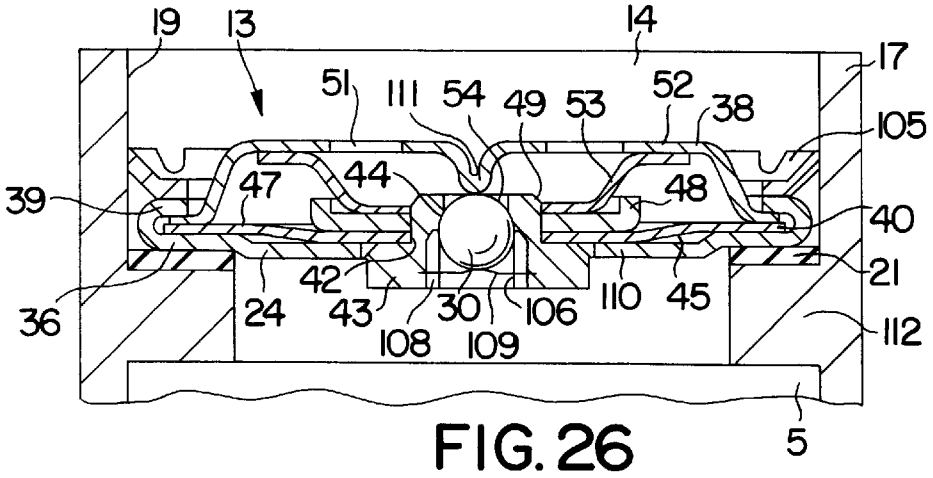
FIGS. 26 and 27 shown an eighteenth and nineteenth exemplary embodiment of a pressure control valve according to the invention.

In the exemplary embodiment shown in FIG. 26 of a pressure control valve 13, the valve seat body 43 is joined to the diaphragm 40 and coaxially to one another in the flow direction has first a guide conduit 106, then the valve seat face 44, and then the return conduit 54 toward the return side 47. The valve closing body 30 embodied as a ball is guided axially in the guide conduit 106. Axial grooves 108 open toward the guide conduit 106 extend in the valve seat body 43 as far as the valve seat face 44 and enable an easy flow around the valve closing body 30 in the guide conduit. Located on the return side 47 of the diaphragm 40 is a spring plate 48, with which the valve seat body 43 extending through the diaphragm 40 in the aperture 42 is joined by means of a deformation 49. A leaf-spring-like closing spring 109 extends transversely through the guide conduit 106 and is fastened by its edges in the valve seat body 43, while its middle region engages the valve closing body 30 and exerts a spring force upon it in the direction of the valve seat face 44, in order to keep the valve closing body in the sealing position on the valve seat face 44. The closing spring 109 is embodied as a soft spring. The diaphragm 40 is fastened at its periphery, together with the circumference of a cup-shaped cap 38 resting on the return side 47, in the base body 24 by means of the crimped edge 39. The base body 24 itself has a retaining shoulder 110 adjoining the collar 38 in the radially inward direction; this shoulder is spaced apart from the collar 36 only slightly and extends horizontally merely to the valve seat body 43. If the fuel supply system is not in operation, then the diaphragm 40 in its position of repose rests on the retaining shoulder 110, without any undesired and impermissible deformation. Supported on the cup-shaped cap 38 is the restoring spring 53, which for instance is embodied as a leaf-spring-like spiral spring and which likewise engages the spring plate 48. A stop lug 111 is formed out of the cap 38, extending into the interior of the cap and pointing in aligned fashion at the valve closing body 38. If the pressure of the fuel in the fuel line 5 is lower than the fuel pressure to be controlled, or if the fuel supply system is not in operation, then an axial spacing exists between the valve closing body 30 and the stop body 111 of the cap 38, the stop body being formed out in the form of a half ring, and the valve closing body 30 rests sealingly on the valve seat face 44. If the fuel pressure on the pressure control side 45 of the diaphragm rises above the fuel pressure to be controlled, then the diaphragm is made to bend in the direction of the cap 38, and the valve closing body 38 comes to rest on the stop body 111 and is prevented by it from any further axial motion with the diaphragm 40, so that the valve closing body 30 lifts from the valve seat face 44, and fuel can flow out to the return side 47 via the valve seat face 44 and the return conduit 54, and the fuel pressure on the pressure control side 45 is kept at the predetermined constant value. The pressure control valve 13, inserted into some unit of the fuel supply system, such as a fuel filter 17 in the fuel tank 1 or in the tank insert unit 2, rests there with the collar 38 in sealed fashion on a protrusion 112 and is fixed on this protrusion by a toothed ring disk 105 engaging the crimped edge 39.

Figure 27:
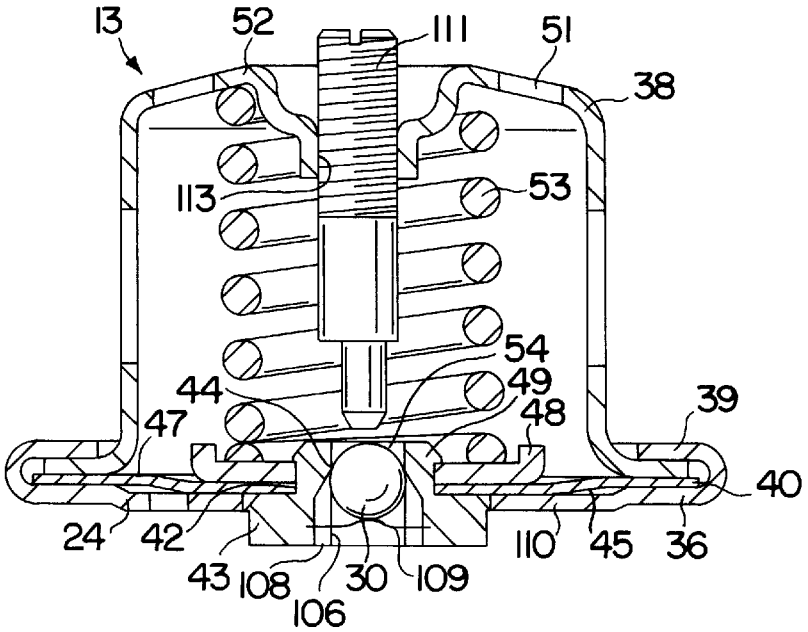

The exemplary embodiment shown in FIG. 27 differs from the pressure control valve of FIG. 26 only in that the cap 38 in its bottom 52 has a central threaded portion 113, which extends for instance into the interior of the cap 38 and into which a stop body 111 embodied as a screw and aligned with the valve closing body 30 is inserted. If the pressure of the fuel on the pressure control side 45 of the diaphragm rises above the predetermined pressure, then the valve closing body rests on the stop body 111 and is lifted from the valve seat face 44, so that fuel can flow to the return side 47. In the exemplary embodiment of FIG. 27, unlike the exemplary embodiment of FIG. 26, the restoring spring 53 is embodied as a compression spring. In the exemplary embodiments of FIGS. 26 and 27, the force of the restoring spring 53 can be varied in each case by bending of the cap bottom 52.

The foregoing relates to preferred exemplary embodiments of the invention, it being understood that other variants and embodiments thereof are possible within the spirit and scope of the invention, the latter being defined by the appended claims.

What is claimed is:

1. A pressure control valve for fuel supply systems of internal combustion engines, having a base body embodied as a cup-shaped sheet-metal body with a bottom (25), and retaining tongues (28) are formed out of the bottom (25) and bent into an interior of the base body (24), these tongues supporting the valve closing body (30); comprising a resilient diaphragm fastened by a periphery of said resilient diaphragm to said base body, the diaphragm having a pressure control side acted upon by the fuel on said pressure control side to be controlled and a return side opposite the pressure control side; a valve seat face located in a middle region of the diaphragm; a valve closing body that cooperates with the valve seat face; and having a spring force that acts in the valve closing direction, the diaphragm (40) is deflectable relative to said periphery in said middle region with the valve seat face (44), and when the valve seat face (44) is lifted from the valve closing body (30), fuel flows via the valve seat face (44) through the diaphragm (40) from the pressure control side (15) toward the return side (47) of the diaphragm (40), and the valve closing body (30) is embodied as a ball and is rotatably supported in a cage form which is built up as an integral part of the base body (24) in contact with the valve closing body (30).

2. The pressure control valve of claim 1, in which the ball-like valve closing body (30) has a flat sealing face (34) toward the valve seat face (44).

3. The pressure control valve of claim 2, in which a cocking spring (31), which urges the valve closing body (30) toward the valve seat face (44), is disposed between the bottom (25) of the base body (24) and the valve closing body (30).

4. The pressure control valve of claim 2, in which a valve seat body (43) having the valve seat face (44) and a return conduit (54) leading from it to the return side (47) is connected to the diaphragm (40).

5. The pressure control valve of claim 2, in which the valve seat face (4) is embodied as flat, conical or spherical.

6. The pressure control valve of claim 1, in which the diaphragm (40) is acted upon on its return side (44) by a restoring spring (53) acting toward the valve closing body (30).

7. The pressure control valve of claim 6, in which the restoring spring (53) is embodied as a compression spring and rests with its end remote from the diaphragm (40) on a cap (38) that is joined by means of a crimped edge (39) to the base body (24), and the diaphragm (40) is fastened between the cap (38) and the base body (24).

8. The pressure control valve of claim 6, in which inlet openings (35) are embodied in the bottom (25) of the base body (24), and a filter (59, 60) covering the inlet openings (35) is disposed on the bottom (25).

9. The pressure control valve of claim 8, in which the filter (59, 60) is retained on the base body (24) by means of a detent connection (57, 58).

10. The pressure control valve of claim 1, in which to adjust the spring force of the restoring spring (53), the base body (24) is deformable in the direction toward the valve seat face (44).

11. The pressure control valve of claim 10, in which the restoring spring (53) is embodied as a leaf spring.

12. The pressure control valve of claim 4, in which the diaphragm (40) is embodied resiliently of metal and has an opening in a middle region which directly forms the valve seat face (44) and a return conduit (54) that leads to the return side (47).

13. The pressure control valve of claim 8, in which a thin-walled return tube (66) is joined to the valve seat body (43) in sealed fashion on the return side (47) of the diaphragm (40).

14. The pressure control valve of claim 2, in which the thin-walled return tube (66) communicates, on the intake side of a fuel pump (4), with a jet pump (3) disposed in the fuel tank (1).

15. The pressure control valve of claim 2, in which the diaphragm (40) is embodied resiliently of metal.

16. The pressure control valve of claim 6, in which toward the valve closing body (30), a leaf-spring-like tension spring acting as a restoring spring (53), which is supported on the base body (24), engages the valve seat body (43).

17. The pressure control valve of claim 16, in which the diaphragm (40) is embodied as flat in its middle portion forming the valve seat face (44).

18. The pressure control valve of claim 6, in which the diaphragm (40) is bent conically or spherically in its middle region forming the valve seat face (44) tapering toward the return conduit (54).

19. A pressure control valve for fuel supply systems of internal combustion engines, having a base body; comprising a resilient diaphragm fastened by a periphery of said resilient diaphragm to said base body, the diaphragm having a pressure control side acted upon by the fuel on said pressure control side to be controlled and a return side opposite the pressure control side; a valve seat face located in the middle region of the diaphragm; a valve closing body that cooperates with the valve seat face; and having a spring force that acts in the valve closing direction, the diaphragm (40) is deflectable relative to said periphery in said middle region with the valve seat face (44), and when the valve seat face (44) is lifted from the valve closing body (30), fuel flows via the valve seat face (44) through the diaphragm (40) from the pressure control side (15) toward the return side (47) of the diaphragm (40), and the base body (24) is embodied as a cup-shaped plastic body with a bottom (25), and the valve closing body (30) provided with a flat sealing face (34) is an integral part of the bottom (25), and a valve seat body (43) that has a flat valve seat face (44) and a return conduit (54) leads from the flat valve seat body to the return side (47) is joined to the diaphragm (40), a pin (82) is provided on the valve closing body (30), said pin (82) protrudes through the return conduit (54) of the valve seat body (43) and on a free end of said pin bears a counterpart bearing disk (84) for a restoring spring (53) that acts on the diaphragm (40).

20. The pressure control valve of claim 14, in which the free end of the pin (82) is provided with a male thread onto which a nut (83) provided with a female thread is screwed, on said nut, the counterpart bearing disk (84) rests and by means of said nut the force of the restoring spring (53) on the diaphragm (40) can be adjusted.

21. A pressure control valve for fuel supply systems of internal combustion engines, having a base body; comprising a resilient diaphragm fastened by a periphery of said resilient diaphragm to said base body, the diaphragm having a pressure control side acted upon by the fuel on said pressure control side to be controlled and a return side opposite the pressure control side; a valve seat face located in the middle region of the diaphragm; a valve closing body that cooperates with the valve seat face; and having a spring force that acts in the valve closing direction, the diaphragm (40) is deflectable relative to said periphery in said middle region with the valve seat face (44), and when the valve seat face (44) is lifted from the valve closing body (30), fuel flows via the valve seat face (44) through the diaphragm (40) from the pressure control side (15) toward the return side (47) of the diaphragm (40), and the base body (24) is embodied as cup-shaped, with a bottom (25) on which a sleevelike valve closing body (30) is secured, whose annular end face toward the diaphragm (40) forms a flat sealing face (34) and whose other end face is closed off by a sleeve bottom (88), and a valve seat body (43) that has a flat valve seat face (44) and a return conduit (54) leading from it to the return side (47) is joined to the diaphragm (40), and a restoring spring (53) in the form of a tension spring engages the sleeve bottom (88) and the valve seat body (43).

22. A pressure control valve for fuel supply systems of internal combustion engines, having a base body; comprising a resilient diaphragm fastened by a periphery of said resilient diaphragm to said base body, the diaphragm having a pressure control side acted upon by the fuel on said pressure control side to be controlled and a return side opposite the pressure control side; a valve seat face located in the middle region of the diaphragm; a valve closing body that cooperates with the valve seat face; and having a spring force that acts in the valve closing direction, the diaphragm (40) is deflectable relative to said periphery in said middle region with the valve seat face (44), and when the valve seat face (44) is lifted from the valve closing body (30), fuel flows via the valve seat face (44) through the diaphragm (40) from the pressure control side (15) toward the return side (47) of the diaphragm (40), and a valve seat body (43) having the valve seat face (44) and a return conduit (54) leading from said return conduit to the return side (47) is joined to the diaphragm (40), and the valve closing body (30), embodied as a ball, is disposed in the valve seat body (43) in a guide conduit (106) located upstream of the valve seat face (44), and that on the return side (47) of the diaphragm (40) a cap (38) is joined to the base body (24), on which cap a stop body (111) is disposed pointing to the valve closing body (30).

23. A pressure control valve for fuel supply systems of internal combustion engines, having a base body; comprising a resilient diaphragm fastened by a periphery of said resilient diaphragm to said base body, the diaphragm having a pressure control side acted upon by the fuel on said pressure control side to be controlled and a return side opposite the pressure control side; a valve seat face located in the middle region of the diaphragm; a valve body that cooperates with the valve seat face; and having a spring force that acts in the valve closing direction, the diaphragm (40) is deflectable relative to said periphery in said middle region with the valve seat face (44), and when the valve seat face (44) is lifted from the valve closing body (30), fuel flows via the valve seat face (44) through the diaphragm (40) from the pressure control side (15) toward the return side (47) of the diaphragm (40), and the valve closing body (30) is embodied as a ball and is rotatably supported in a cage form which is built up as an integral part of the base body (24) in contact with the valve closing body (30), the base body (24) is cup-shaped, with a bottom (25) in which the inlet openings (35) are provided around a central bearing region (62), wherein retaining tongues (28) of a cup-shaped retaining sleeve (64) protrude through the inlet openings (35) into the interior of the base body (24) and support the valve closing body (30) on the central bearing region (62).

24. A pressure control valve for fuel supply systems of internal combustion engines, having a base body; comprising a resilient diaphragm fastened by a periphery of said resilient diaphragm to said base body, the diaphragm having a pressure control side acted upon by the fuel on said pressure control side to be controlled and a return side opposite the pressure control side; a valve seat face located in the middle region of the diaphragm; a valve body that cooperates with the valve seat face; and having a spring force that acts in the valve closing direction, the diaphragm (40) is deflectable relative to said periphery in said middle region with the valve seat face (44), and when the valve seat face (44) is lifted from the valve closing body (30), fuel flows via the valve seat face (44) through the diaphragm (40) from the pressure control side (15) toward the return side (47) of the diaphragm (40), and the valve closing body (30) is embodied as a ball and is rotatably supported in a cage form which is built up as an integral part of the base body (24) in contact with the valve closing body (30), the base body (24) is embodied of plastic and has a collar (36), on which the diaphragm (40) rests by a circumferential edge, and remote from the collar (36) the base body (24) has a bearing portion (95) which forms the cage form for supporting the valve closing body 30.

25. The pressure control valve of claim 1, in which the bearing portion (95) has elastic retaining lugs, (97), which define a circular cross section of shorter radius than the radius of the valve closing body (30).

26. The pressure control valve of claim 2, in which a cocking spring (31) engages the side of the valve closing body (30) remote from the diaphragm (40) and urges the valve closing body (30) in the direction toward the retaining lugs (97).

27. The pressure control valve of claim 2, in which the diaphragm (40) is fastened to the collar (36) of the base body (24) by means of a tubular intermediate part (102) of plastic, and remote from the base body (24) a cup-shaped cap part (103) of plastic engages the intermediate part (102), the cap part being axially movable relative to and fixable on the intermediate part (102).

28. The pressure control valve of claim 27, in which in the middle region with the diaphragm (40) a valve seat body (43) of plastic is joined to the diaphragm (40), and the valve seat body (43) has a valve seat face (44) and a return conduit (54) leading from it to the return side (47).

29. The pressure control valve of claim 28, in which a restoring spring (53) embodied as a compression spring is disposed between the cap part (103) and the valve seat body (43).

30. The pressure control valve of claim 22, in which a soft closing spring (109) is disposed in the valve seat body (43), engaging the side of the valve closing body (30) remote from the valve seat face (44) and urging it in the direction toward the valve seat face (44).

* * * * *